US007774982B2

(12) United States Patent
Kaiser

(10) Patent No.: US 7,774,982 B2
(45) **Date of Patent: *Aug. 17, 2010**

(54) TURN-TILT WINDOW

(75) Inventor: Konrad Kaiser, Geseke (DE)

(73) Assignee: Schueco International KG, Bielefeld (DE)

( * ) Notice: Subject to any disclaimer, the term of this patent is extended or adjusted under 35 U.S.C. 154(b) by 0 days.

This patent is subject to a terminal disclaimer.

(21) Appl. No.: 11/544,644

(22) Filed: Oct. 10, 2006

(65) Prior Publication Data

US 2007/0068082 A1 Mar. 29, 2007

Related U.S. Application Data

(63) Continuation of application No. PCT/EP2005/003660, filed on Apr. 7, 2005.

(30) Foreign Application Priority Data

Apr. 8, 2004 (DE) ..... 10 2004 018 066

(51) Int. Cl.
*E05D 15/52* (2006.01)

(52) U.S. Cl. ..... 49/192; 49/193; 49/382

(58) Field of Classification Search ..... 49/192, 49/382, 193

See application file for complete search history.

(56) References Cited

U.S. PATENT DOCUMENTS 2,715,665 A * 8/1955 Taylor ..... 200/302.1
3,690,035 A * 9/1972 Schindlauer et al. ..... 49/192
4,811,518 A * 3/1989 Ladisa ..... 49/193
5,226,256 A 7/1993 Fries et al.
2004/0128914 A1 * 7/2004 Hempelmann ..... 49/192

FOREIGN PATENT DOCUMENTS

CH 375624 2/1964
DE 39 15 569 A1 11/1990

(Continued)

OTHER PUBLICATIONS

International Search Report dated Jun. 8, 2005.

(Continued)

*Primary Examiner*—Gregory J. Strimbu
(74) *Attorney, Agent, or Firm*—Crowell & Moring, LLP

(57) ABSTRACT

A turn-tilt window includes a blind frame and a leaf, which can be tilted in relation to the blind frame about a first axis (X axis) and turned about a second axis (Y axis), fittings, located between the leaf and the blind frame, for moving the leaf in relation to the blind frame, the fittings including at least one turn-tilt bearing, a rocker bearing, and a turn hinge. An electromechanical or electromagnetic functional element is associated with at least one of the rocker bearing and the turn hinge in order to control movement the leaf in relation to the blind frame. The functional element is controlled by a handle which is connected thereto via a wireless manner or by electric lines and is not connected to the functional element, the rocker bearing, or the turn hinge by any mechanical linkages.

14 Claims, 8 Drawing Sheets

FOREIGN PATENT DOCUMENTS

| | | | |
|---|---|---|---|
| DE | 43 21 099 | A1 | 1/1994 |
| DE | 196 03 768 | A1 | 8/1997 |
| DE | 297 09 259 | U1 | 9/1997 |
| DE | 32 50 129 | C2 | 4/1999 |
| DE | 199 38 253 | A1 | 2/2001 |
| DE | 101 05 845 | A1 | 8/2002 |
| DE | 101 25 401 | A1 | 12/2002 |
| EP | 1 076 147 | B1 | 2/2001 |
| EP | 1 323 885 | A2 | 7/2003 |

OTHER PUBLICATIONS

Schüco International, Corona Systembeschlag, Sicherheitsfenster SF II—einsetzbar im Drehkipp-, Dreh- und Kippflügel, 10.97, p. K4 (Published 1997 or later).

Schüco International, System Schnicks, 04-009 (Published 1997 or later).

German Search Report for DE 10 2004 018 066.0 dated Apr. 8, 2004.

* cited by examiner

TURN-TILT WINDOW

CROSS-REFERENCE TO RELATED APPLICATIONS

This application is a continuation of PCT International Application No. PCT/EP2005/003660, filed on Apr. 7, 2005, which claims priority under 35 U.S.C. §119 to German Application No. 10 2004 018 066.0, filed Apr. 8, 2004, the entire disclosures of which are expressly incorporated by reference herein.

BACKGROUND AND SUMMARY OF THE INVENTION

The invention relates to a turn-tilt window, including a blind frame and a leaf, which can be tilted in relation to the blind frame about a first axis and turned about a second axis, and fittings, located between the leaf and the blind frame, for moving the leaf in relation to the blind frame, the fittings including at least one turn-tilt bearing, a rocker bearing, and a turn hinge and, preferably, a deployment device.

In the case of such windows of the prior art design, the leaf is opened and closed by way of a handle, which is connected in series to a gear—in particular a connecting rod gear, which is connected in a direct mechanical manner to the handle and acts on the locking mechanisms for disengaging and locking the leaf in a blind frame.

The locking elements of such windows and the fittings for moving the leaf, such as a rocker bearing, a pivot bearing, and the deployment device, are moved circumferentially at the window by connecting rods, which are actuated by the window grip. The connecting rod fittings may be constructed, for example, as face plate fittings. The connecting rod is fastened in a pre-fabricated manner below a face plate, which is inserted fully into a groove and are connected together by use of suitable corner guide units. These face plate fittings are mechanically relatively complicated; and, for the entire range of existing windows, a large and expensive inventory is necessary.

In the case of aluminum windows, the fact that the lock bars may be guided, as individual components, in grooves of the frame profile and may be equipped selectively with locking elements has gained acceptance. In the corner area, the individual connecting rods must also be connected to corner guides, in order to enable the locking of the window leaf in the frame struts. In this case, the supply of fittings is, in fact, less expensive, but, in contrast, the cutting to size and the machining of the lock bar requires a certain amount of financial outlay.

It is also known to open and to close windows by use of electromechanical drives. In such windows, switches are used for actuating the drives. These embodiments have also gained acceptance. However, operating these windows is often tedious and unclear.

Against this background the invention is based on the problem of further simplifying the assembly and production costs of windows having electromechanical or electromagnetic components.

The invention solves this problem by providing a turn-tilt window including a blind frame and a leaf, which can be tilted in relation to the blind frame about a first axis and turned about a second axis, and fittings, located between the leaf and the blind frame, for moving the leaf in relation to the blind frame, the fittings including at least one turn-tilt bearing, a rocker bearing, and a turn hinge and, preferably, a deployment device. An electromechanical or electromagnetic functional element, in particular a coupling element, is allocated to at least one or more of the fittings in order to move the leaf in relation to the blind frame. The functional elements is drivable in a wireless manner or by way of electric lines and is configured to couple the fittings into and out of their functional position. A control unit, which is designed at least for driving the functional elements, is provided and is coupled to the handle in a wireless manner, by an electric line, or by at least one data line.

Advantageous embodiments are described and claimed herein.

According to the above, an electromechanical or electromagnetic functional element, in particular a coupling element, is allocated to at least one or more of the fittings in order to move the leaf in relation to the blind frame. The functional elements are drivable in a wireless manner or by way of electric lines and are configured to displace the fittings into and out of their functional position in order to move the leaf in relation to the blind frame. Furthermore, there is a control unit, which is designed at least for driving the functional elements. The functional elements act as couplings, which couple and uncouple the fittings in a functional position into and out of the functional position, in which the fittings act as rotary joints. Therefore, a mechanical connection between an operating element, like a handle, and the fittings, may be dispensed with, a feature that significantly reduces the cost for producing the turn-tilt window and the need for an inventory of a variety of different components.

In the case of the turn-tilt window it is desirable to allocate one of the functional elements to at least the rocker bearing and the turn hinge. The function of the turn-tilt bearing, provided, for example, with a ball cup, is to "turn" and tilt in both window positions, but the turn-tilt bearing does not have to be put, as a rule, into its various functional positions by way of a coupling.

Preferably, a rebated area is configured between the blind frame and the leaf; and at least one or more of the electromechanical or electromagnetic locking elements is/are arranged and distributed in or on the rebated area. The electromechanical or electromagnetic locking elements bridge the rebated area and serve to lock the leaf into the blind frame in the closing position of the window. The control unit is also configured for driving the functional elements. Even a mechanical connection, like a gear—in particular a connecting rod gear—, which was provided hitherto between the handle and the locking mechanisms, may be dispensed with, a feature that has considerable cost advantages.

Furthermore, a handle, mounted on the leaf, is provided preferably as an operating mechanism. The handle has a grip piece, which can be moved—in particular can be turned—into a number of different gripping positions at the leaf, the gripping positions corresponding to the various operating positions of the leaf. Therefore, the handle has switching elements and/or sensors; and the handle is connected in a wireless manner or by way of electric lines to electromagnetic or electromechanical locking elements for the leaf and/or to the electromagnetic or electromechanical functional elements for the fittings and/or to the electromechanical drive mechanism for opening and closing the leaf. In particular, the handle is not connected to the locking elements and/or the fittings by way of any mechanical elements, like a gear; and the blind frame and the leaf are configured without any connecting rods. At the same time, the handle is employed in the conventional way for "manipulating" the window. Especially when the handle is configured now as before for opening and closing the leaf manually, the user does not have to become familiar with the handling of new operating and switching elements, even though their employment in a turn-tilt window, according to the invention, can be realized in principle (e.g. by means of a touch screen or push-button or the like).

It is also contemplated, according to an alternative embodiment, that the window has an electromechanical drive for opening and closing the leaf automatically. In this case, too, however, it is advantageous if the leaf is manipulated by means of a grip piece, as typically installed in windows. However, the combination of an electromagnetic locking of the window as well as an electromechanical or electromagnetic coupling of its fittings and a mechanical opening and closing "by hand", especially when the leaf is turned, is preferred, especially for cost reasons.

According to another preferred embodiment, a rebated area is configured between the blind frame and the leaf; and at least one or more of the locking elements is/are disposed and distributed in or on the rebated area. The locking elements bridge the rebated area and are used to lock the leaf into the blind frame in the closing position of the window. Therefore, at least one locking element can be driven in a wireless manner or by way of electric lines, as a function of the gripping position of the handle, or some other operating mechanism and exhibits an electromagnetically or electromechanically acting closing element. Electromechanical closing elements are disclosed per se in DE 195 14 051 A1, according to which individual locking elements are provided on a door, which may be swiveled about a single axis. Furthermore, the locking elements engage in recesses of a frame, in particular a casement frame, and can be unlocked by means of electromagnets.

According to another further development of the invention, which can also be viewed independently, an electric monitoring unit for registering the gripping position of the handle is allocated to the handle. The monitoring unit is configured, for example, as a computer, which registers and transmits the position of the switching elements or the information of the sensors at the handle. The handle is connected preferably to the monitoring unit in a wireless manner or by means of an electric line. Therefore, it is possible to register and monitor the position of the handle and, thus, the position of the window directly at the window, or also in a central monitoring station of a building. The monitoring unit and the control unit may also be integrated into one unit.

An electric circuit is allocated preferably to the handle directly on the leaf. The electric circuit is disposed expediently and compactly in a grip housing, especially along the line of a rosette, or for example, at the rebated area or in a chamber or recess of the casement frame.

The leaf may be constructed without a frame. In this case, the handle is fastened on the pane. However, the leaf exhibits, preferably, a blind frame for receiving the handle.

An essential feature of the handle is that it has the grip piece, which is configured to be turned into a number of different gripping positions, which can be clearly distinguished by eye from one another, so that clearly distinguishable functional positions may also be allocated to the gripping positions. Precisely in this case the manipulation of the window is especially easy without the need for any additional operating elements, like a push-button or the like.

Otherwise, it is possible to design the handle in all possible ways, especially along the line of a loop-type grip, or a turn grip, or the like. However, it should always be provided that the grip piece can be moved, preferably swiveled, into various gripping positions.

Preferably, the leaf exhibits a casement frame. Similarly, however, the blind frame is preferably not automatically configured in a circumferential manner.

Suitable locking and functional elements are, according to an especially preferred alternative, electromechanical components.

The drive is carried out by electric lines or by a wireless connection, e.g. a radio connection.

The invention is described in detail below by means of the embodiments with reference to the drawings.

Other objects, advantages and novel features of the present invention will become apparent from the following detailed description of the invention when considered in conjunction with the accompanying drawings.

DETAILED DESCRIPTION OF THE DRAWINGS

Figure 1:
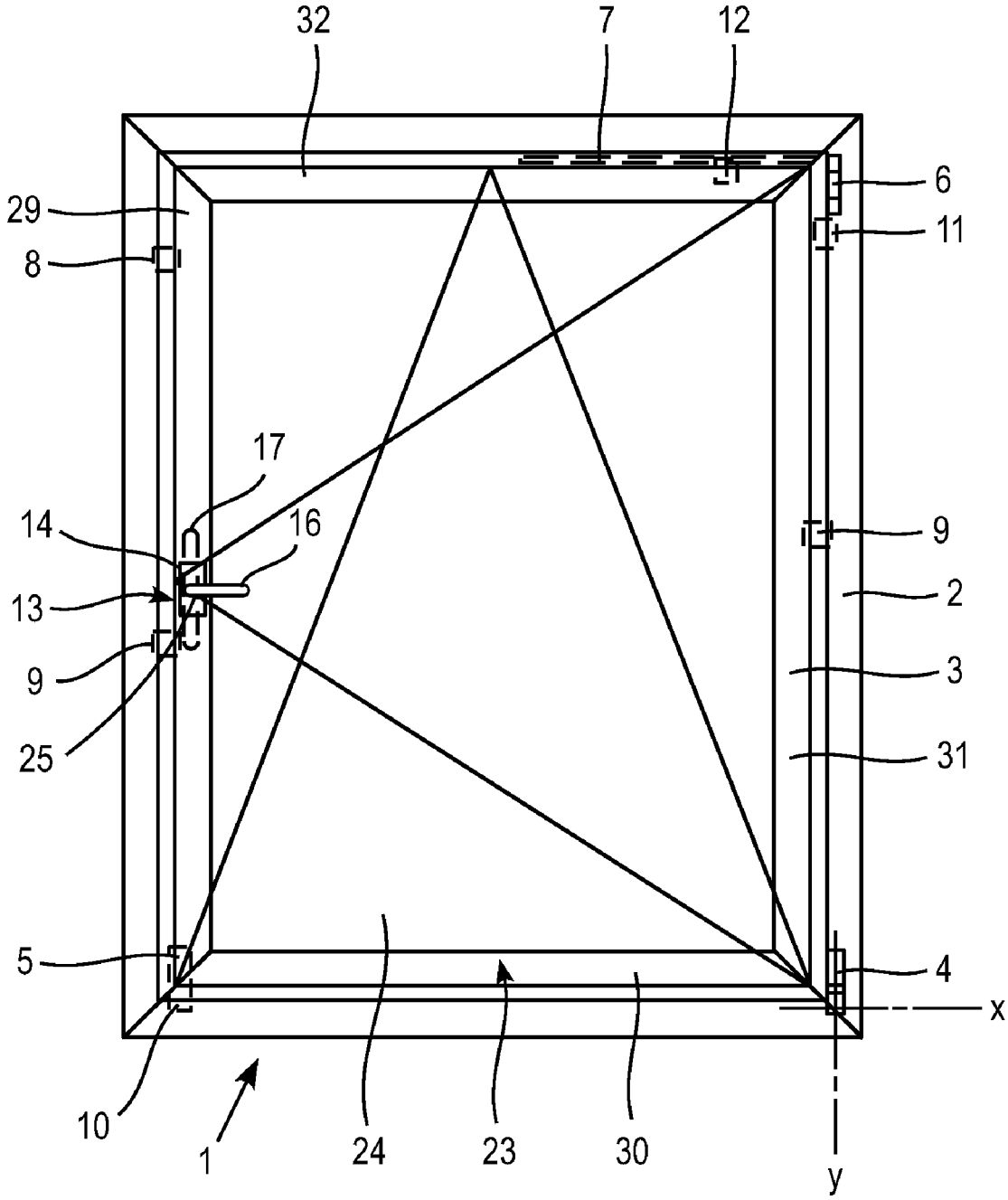
FIG. 1 is a schematic view of a turn-tilt window with a first handle.

FIG. 1 depicts a turn-tilt window 1 including a blind frame 2 and a leaf 23, which exhibits here a casement frame 3 and holds a pane 24.

The turn-tilt window is arranged so as to be tiltable about a first axis x, oriented horizontally in the standard installation position, and is arranged so as to be rotatable about a second axis y, which is vertical here.

For this purpose the window 1 exhibits a turn-tilt bearing 4, a disconnectable rocker bearing 5, and a turn hinge 6, as the fittings, between the blind frame 2 and the casement frame 3. The pivot bearing is constructed as a turn hinge and is fastened on the casement frame 3 and is fixed in a disconnectable manner in the blind frame 2.

Depending on whether the window is tilted or turned, or whether it is closed, these fittings, or rather in this case these bearings, are or are not in their functional position. Therefore, during tilting movements, the rocker bearing 5 is in its functional position; and the turn hinge 6 is not. In contrast, during turning movements the turn hinge 6 is in its functional position; and the rocker bearing 5 is not. Furthermore, there is a deployment device 7, as the additional moveable fitting, at the edge of the window between the blind frame 2 and the casement frame 3. The deployment device serves to define the tilt position of the leaf in relation to the blind frame 2.

The turn hinge 6 is coupled in a disconnectable manner, as a function of its design, to the blind frame 2 or to the casement frame 3 in the lock position of the window and in the swivel position about the Y axis and is rigidly disposed correspondingly on the casement frame or blind frame. In the latter case the turn hinge 6 and the deployment device 7 form a unit.

Furthermore, in the turn-tilt window, depicted in FIG. 1, a subgroup of the fittings, which are necessary for realizing the moveability between the leaf and the blind frame—in this case the rocker bearing 5 and the turn hinge 6 as well as also the deployment device 7—has functionally at least one electromechanical functional element 10, 11 and/or 12, with which the fittings 5, 6 and 7 are coupled into or uncoupled out of their functional position, as a function of the actuation in their functional position, in order to move the leaf 23 either into its tilt position or into its turn position or to lock the leaf 23 into its lock position in the blind frame 2.

The "activation" and/or "deactivation" of the rocker bearing 5 and/or the turn hinge 6 is/are carried out by way of electromechanically acting coupling elements 10, 11. The electromechanical element 10 controls the rocker bearing 5 between the leaf lock position and the leaf turn position about the X axis, on the one hand, and the disengagement position for the swivel position of the leaf about the Y axis.

The electromechanical element 11 ensures, on the one hand, the fixing of the turn hinge 6, which is disposed on the leaf 23, in the blind frame 2 in the leaf position and the swivel movement about the Y axis and, on the other hand, releases the turn hinge 6, when the leaf 23 is positioned in the X axis.

As an alternative, the deployment device 7 may also be connected to the turn hinge 6. Then, the turn hinge 6 is attached to the blind frame 2 and can be coupled to the leaf 23 by use of the deployment device. Furthermore, the deployment device 7 may be used optionally for opening and closing the turn-tilt window into and out of the tilt position and defining a tilt and turn moveability of the leaf by way of elements (not illustrated here), like an electric motor and a gear—in particular a chain or cable, attached to the deployment device.

The coupling element 11 ensures the engagement of the turn hinge 6 at the leaf 23 during the pivot movements about the Y axis in its functional position. During the tilt movements, in contrast, the turn hinge is disabled in its deactivated position. The other functional elements 10, 12 work in a manner analogous with respect to the rocker bearing 5 and the deployment device 7. Specifically, the movements of rocker bearing 5 and deployment device 7 are either deactivated and/or blocked or released, for example, by way of electromechanically operated functional elements including moveable bolts or the like, depending upon whether the leaf is pivoted or tilted.

Locking elements 8, 9, which are located between the blind frame 2 and the casement frame 3, are arranged in or on the rebated area, existing between the blind frame and the casement frame, point-by-point or rather only at individual spots of the rebated area that are set apart from each other. The locking elements 8, 9 bridge the rebated area and are used to lock the leaf 23 into the blind frame 2 in the lock position of the window.

There are here, by way of example, three locking elements on the edge of the leaf 23 on the side of the turn hinge 6 and the edge of the casement frame 3, which is located opposite the turn hinge 6.

It is also contemplated to provide additional locking elements 8, 9 on the other sides, especially on the top side and the bottom side of the window, and/or a different number of locking elements 8, 9. The locking elements 8, 9 can be actuated here in a wireless manner or by way of electric lines (cannot be recognized here) and be in the form of an electromagnetically or especially electromechanically acting locking element. An electromechanical locking element is preferred in order to generate an adequate amount of locking force, optionally in connection with additional translation elements, like tightening slopes, eccentrics, expanding wedges. Therefore, the locking procedure shall be carried out preferably by way of the electromechanical drive and the opening by way of electromechanical means or preferably, among other things, by way of a spring, since in general when a window is opened, there is less time available than when closing and locking the window.

A handle 13, which is mounted on the casement frame 3 and has a shaft and a grip piece 25, which can be moved—in this case turned—into different gripping positions on the shaft in relation to the casement frame 3, is used as the actuating element for the leaf 23.

The gripping positions of the handle 13 are to be distinguishable by a user on direct visual inspection. In the gripping positions, which differ from each other by a number of angles, in this case 90 deg., and are provided here by way of example for a turn-tilt window, the leaf 23 is either locked or can be tilted or turned.

The handle 13 is used here for the purpose of both tilting and turning the window, thus for generating the mechanical force to move the leaf 23 in relation to the blind frame. However, the handle 13 is not used, as otherwise typical, for the purpose of actuating the locking elements and/or the fittings by way of a mechanism. Rather, this task is carried out here by the use of electric lines or in a wireless manner without any mechanical connection to the fittings 5, 6, 7, in that the switching position of the handle 13 is registered by way of a detection device, like switching contacts or sensors (e.g. Reed contacts) and is used for actuating the electromagnetically or electromechanically acting locking and functional elements, in order to use the fittings in either the tilting functional position or the turning functional position or to close the window.

In FIG. 1, the handle 13 is configured in such a way that the downwards pointing gripping position is equivalent to the lock position of the window, in which all of the locking and functional elements 8, 9; 10-12 are located in the locking and/or lock position.

In contrast, the gripping position 16 corresponds to the option of displacing the leaf 23 into its turn position. In this gripping position, the locking elements 8, 9 and the functional element 10 for the rocker bearing 5 are unlocked.

However, in the tilt turn position 17—in this case where the gripping position of the handle is pointing upwards—the leaf 23 may be tilted so that in this gripping position the locking elements 8, 9 and the functional element 11 for the turn hinge 6 are unlocked.

The handle 13 or some other operating unit (not illustrated here) is not connected to the locking elements 8, 9 or the fittings by way of any mechanical elements, like a gear, especially a connecting rod arrangement. Since a mechanical gear connection between the handle and the locking elements and the fittings is dispensed with, the cost of manufacturing the window is reduced, on the one hand; and, on the other hand, it offers the option of transmitting the registered gripping positions to a higher ordered monitoring unit (not illustrated here) by way of a wireless connection or some other connection of the grip piece and/or the switching and/or sensor elements, allocated to the grip piece. This makes it possible, for example, to register and to monitor by means of a central station the position of the window of a building without any additional sensor technology between the blind frame and the casement frame.

According to an advantageous alternative of the invention, the switching and/or sensor elements of the handle 13 as well as optionally other electric or electronic components, like interface components to a databus and/or energy bus of a building's automation system, may be housed in a grip housing 14—in this case, formed as a rosette in the outward direction—, without negatively modifying the visual impression, compared to conventional, purely mechanically acting handles.

As an alternative, it is also contemplated (not illustrated here) to house an electric circuit for the handle 13 in, or in the vicinity of, the handle 13, thus in the rebated area, a chamber or in a recess of the casement frame.

The handle 13 enables, on the one hand, the customary manipulation of the window and, on the other hand, is used—depending on the configuration—as a switching and/or information module owing to its electronics including sensor and/or switching elements.

Figure 2:
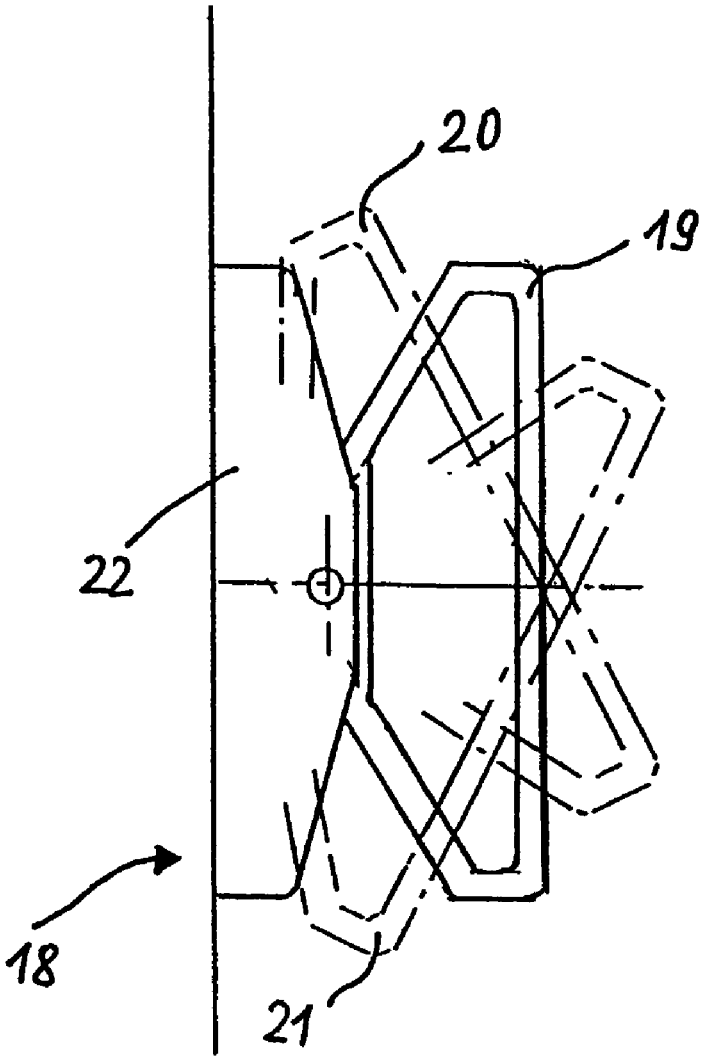
FIG. 2 is a schematic view of another handle for a turn-tilt window in a number of gripping positions.

FIG. 2 depicts another example of a handle 18 for a turn-tilt window. The handle, depicted in FIG. 2, exhibits a loop-type grip 19, which can be turned and/or tilted, like a rocker, into different gripping positions in relation to a grip housing 22, fastened to the leaf 23. In the gripping position, bearing the reference numeral 19, the window is closed; in the position bearing the number 20, it may be displaced into its tilt position; and in the position of the handle 18, bearing the number 21, said window may be displaced into its turn position.

The number of locking elements varies as a function of the size of the leaf. In a turn-tilt window of a smaller model, at least one locking element 11 is necessary. Preferably, one locking element is provided on the grip side of the vertical frame strut 29. In the case of larger window casements and as a function of the window installation conditions, the four frame struts 29-32 of the casement frame 3 may have additional locking elements, which lock the leaf virtually point-by-point or rather spot-by-spot.

In theory, the turn-tilt window, depicted in FIG. 1, could also exhibit, instead of a handle 13, other types of switching elements, like a push-button, and/or a control unit at another location other than in the rosette. However, the handle 13 is preferred as an especially simple manipulating and operating element and is combined with the associated control circuit into one functional unit.

Figure 3:
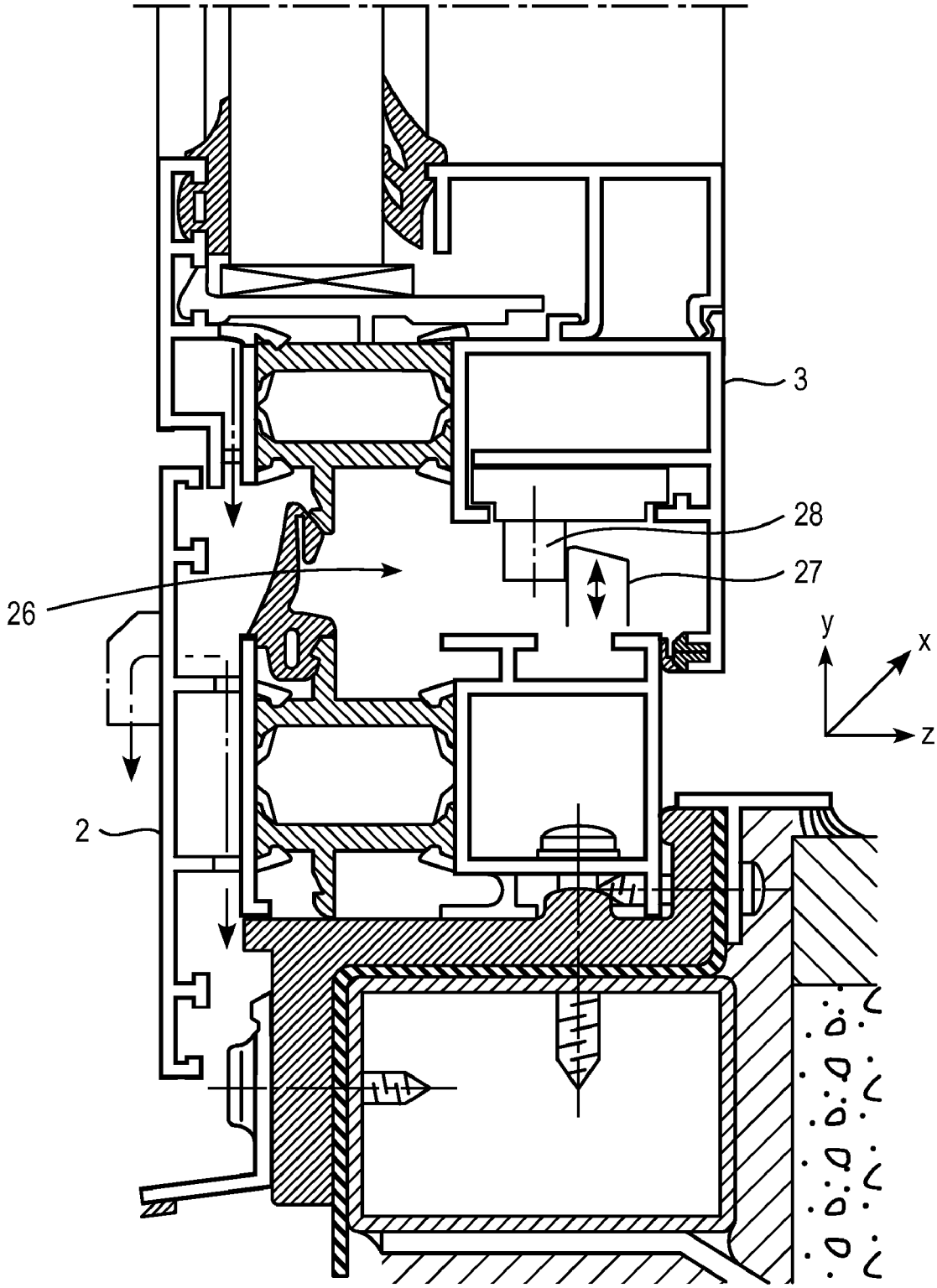
FIG. 3 is a sectional view of a schematic representation of a rebated area of a window.

FIG. 3 is a sectional view of a frame of a window comprising a blind frame 2 and a casement frame 3. One of the locking elements 8, 9, which can be operated electromechanically, is represented schematically in the rebated area 26. Each locking element 8, 9 comprises an electromechanically driven, moveable locking slide 27, which can be moved in the direction of the pane plane in the direction of the casement frame 23 and in its locking position engages behind a locking abutment 28, like a roller or a bolt, which is stationary at the leaf or rather cannot be moved in relation to the leaf 23.

FIGS. 4*a*-4*d* are schematic drawings of such a locking mechanism in various operating positions.

FIGS. 4*a*-4*d* depict an electromechanical drive mechanism 33, which is shown merely in schematic form and which has an electric motor and, preferably, a gear (not illustrated here in detail), connected on the outgoing circuit of the electric motor. This drive mechanism 33 is arranged preferably on the blind frame (or, as an alternative, on the leaf).

According to FIGS. 4*a*-4*d*, the locking slides 27 are provided with control curves, especially tightening slopes 34, in such a way that, on locking with a predetermined force, the leaf 23 is pulled over a path "c" in the direction of the blind frame 2, so that the leaf 23 rests flush against the blind frame 2 with a predetermined force.

The gear enables the linear movement of the locking slide 27 into its axial direction or rather in the direction of the corresponding window section—here the leaf 3—as well as in the direction of the locking abutment 28, which is fixed in position on the moveable leaf (not illustrated here).

The side of the locking slide 27 that faces the locking abutment 28 exhibits a control curve (here a tightening slope 34), which may also be configured on a projection 35, which is molded radially to the actual locking bolt and extends only over a portion, in particular an end area of the locking slide 27.

The function of this arrangement is as follows.

Figure 4A:
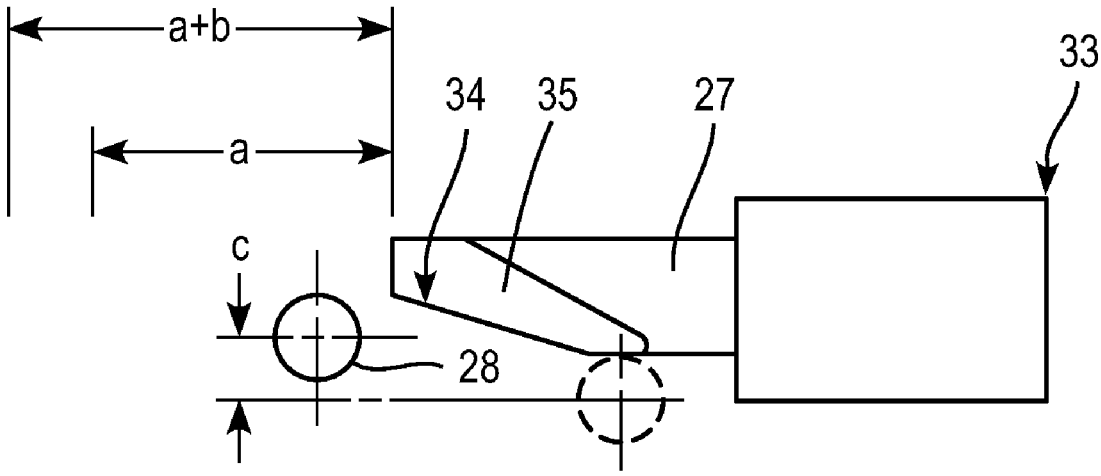
FIGS. 4*a-d* are schematic views of an electromechanically operated locking mechanism for a window in various operating positions.
Figure 4B:
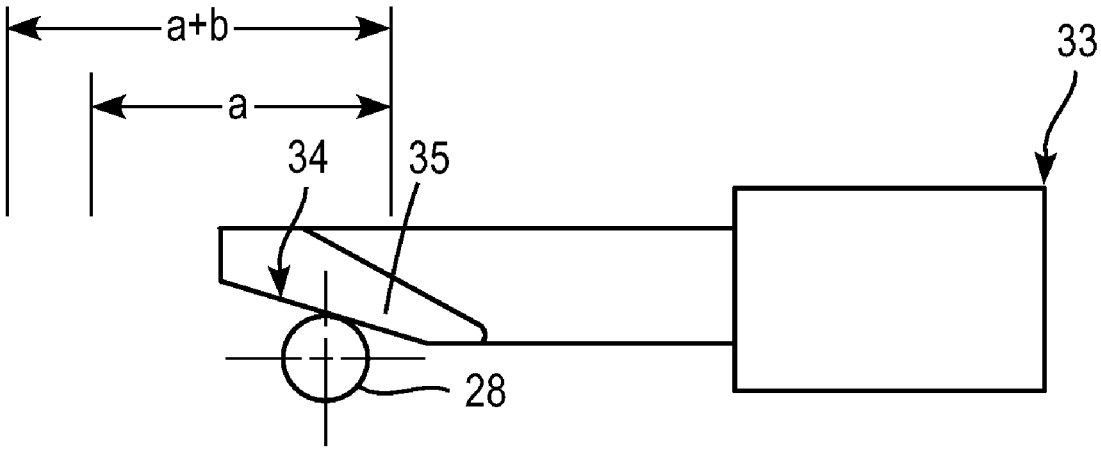
Figure 4C:
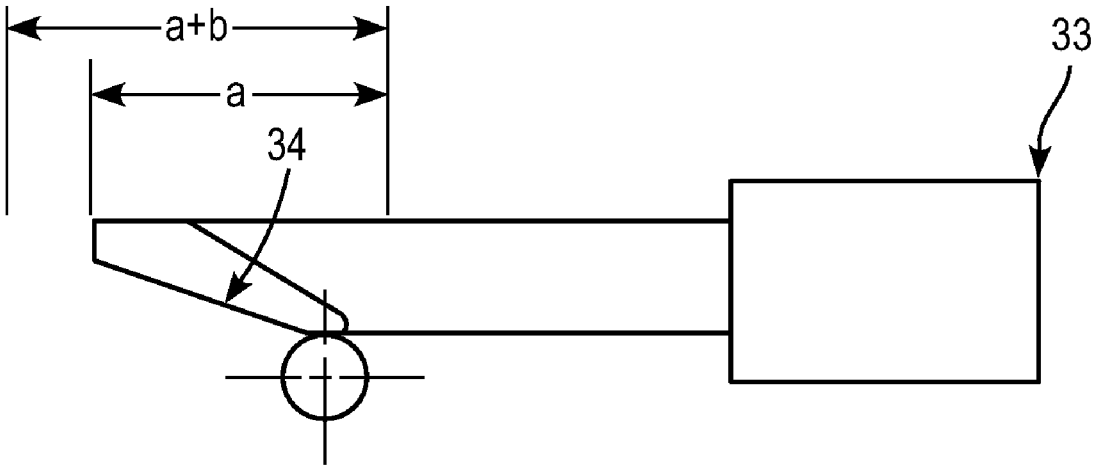

When closing the window, the locking slide 27 is extended out from a retracted position (FIG. 4*a*) from the blind frame 2 in the direction of the casement frame 3, until the locking slide 27 rests with its tightening slope 34 against the outside radius of the locking abutment 28 (FIG. 4*b*). If the locking slide 27 is extended further, the locking abutment 28 on the leaf 3 as well as the leaf 3 itself are pulled perpendicularly to the pane plane in the direction of the blind frame 2, until a locking position is reached, in which the path of the tightening slope 34 is totally traversed, so that the lock position may be retained (locking position of FIG. 4*c*), even when there is no current flow to the motor.

According to an alternative, the lock path along the tightening slope 34 may be traversed in reverse for the purpose of unlocking (not illustrated).

Figure 4D:
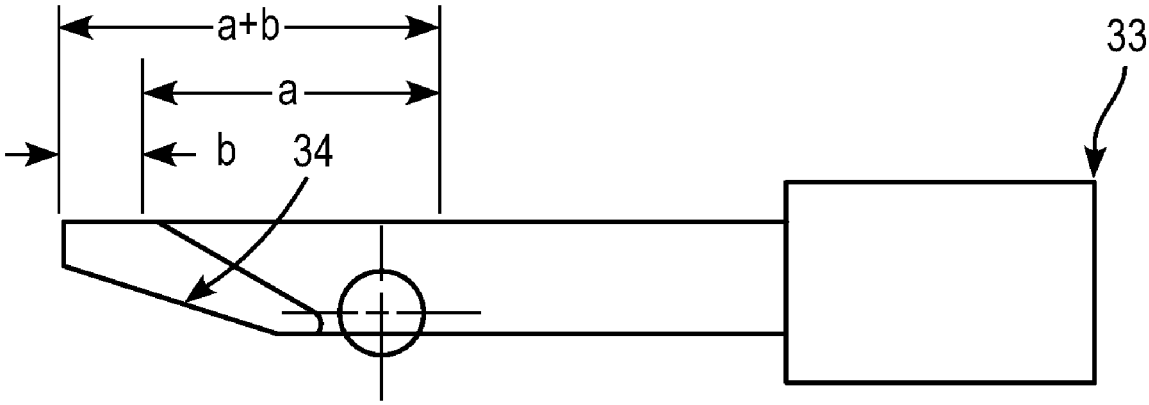

However, to open the leaf as fast as possible, it is also contemplated to extend the locking slide 27 further, until the slide reaches a position, at which it slides past the projection 35 with the tightening slope 34, so that the leaf 23 may disengage extremely fast from the blind frame 2 (FIG. 4*d*).

When locking the window, the path "a", which is to be traversed linearly by the locking slide 27 in its direction of displacement, is clearly longer than the path "b", to be traversed when unlocking prior to opening (the ratio of a to b is significantly greater than 2 to 1), so that even the time that is required until the window is unlocked and may be opened after actuating the operating element, especially after turning the handle 13, is less than the time that is required by the drive to lock the window after, for example, manually closing and then turning the handle 13. This feature is advantageous, because especially the opening procedure is always supposed to be fast, whereas the user is not troubled if it takes longer to lock after closing the window or rather after pressing the leaf against the blind frame 2.

FIGS. 5 *a*-5*d* show an alternative embodiment. In this case, the locking procedure is carried out in a manner analogous to that in FIGS. 4*a*-4*d*, but the unlocking is done by use of an unlocking spring 36.

Therefore, a drive housing 37 for the electric motor and a gear are configured in such a way that it also accommodates the unlocking spring 36, in particular a helical spring.

The unlocking spring 36 envelops the locking slide 27 and is braced against two stops 38, 39, which envelop concentrically the locking slide 27. Therefore, one of the stops 38 envelops disk-like the locking slide 27 and is fixed axially to the same; and the other is constructed as a housing wall 40 of the drive housing 34, through which the locking slide 27 extends moveably. The projection 41, protruding beyond the drive housing 37, has a head piece 42 of predetermined length, which in turn is provided with the tightening slope 34.

The locking procedure is carried out as in FIGS. 4*a*-4*d*, but an eccentric mechanism comprising an eccentric pin 43 is configured in the drive housing 37 on the end of the locking slide 27. The eccentric pin moves over a circular path 44; and on closing, it acts on a radial stop 45 on or around the locking slide 27, which is connected stationarily to the locking slide 27, so that the eccentric pin advances via the stop 45 the locking slide 27 outwards out of the drive housing (as far as up to the locking position of FIG. 5*c*).

If the eccentric pin is moved further, it slides past the edge of the stop 45, so that the locking abutment 28 in turn is disengaged, so that the unlocking spring 36 may relax.

Figure 5A:
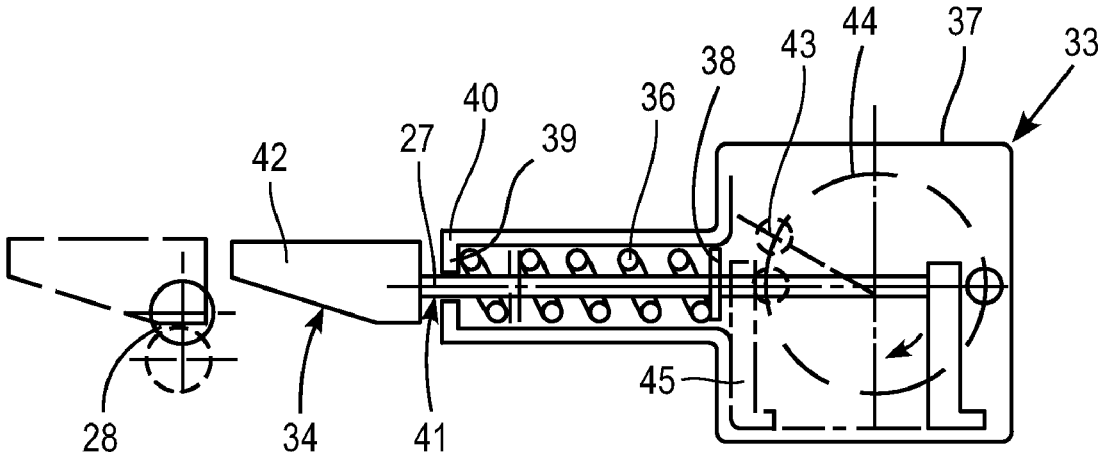
FIGS. 5*a-d* are schematic views of another electromechanically operated locking mechanism for a window in various operating positions.
Figure 5B:
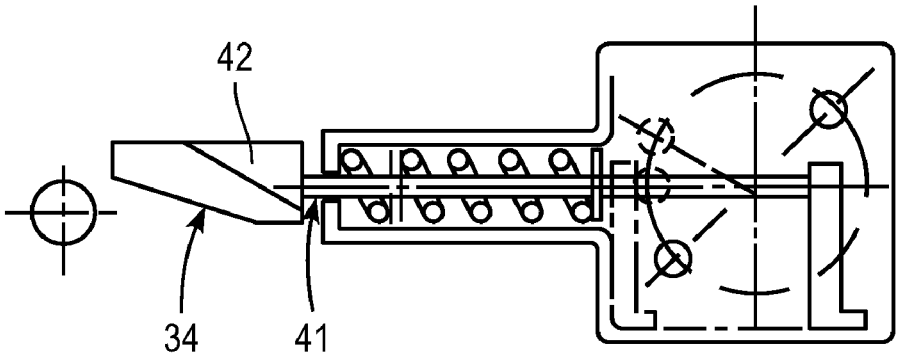
Figure 5C:
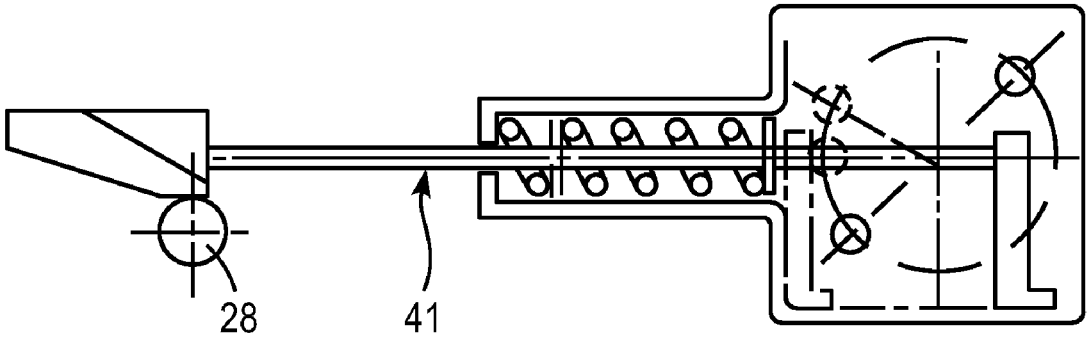
Figure 5D:
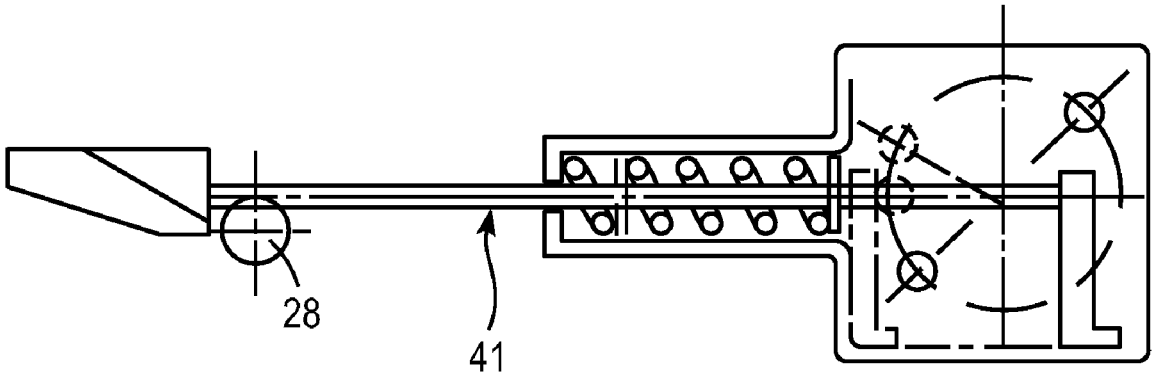

In contrast, the circular path 44 of the eccentric pin 43 is measured and adjusted, according to FIG. 5*b*, in such a manner that the closing position is reached as early as after less than half the circular path 44 and that, when the eccentric pin continues to traverse the circular path 44, the locking slide 27 extends further, until it in turn reaches a position, at which the head piece 42 is released, so that the leaf 23 in turn may quickly disengage from the blind frame 2 (FIG. 5*d*).

Figure 6:
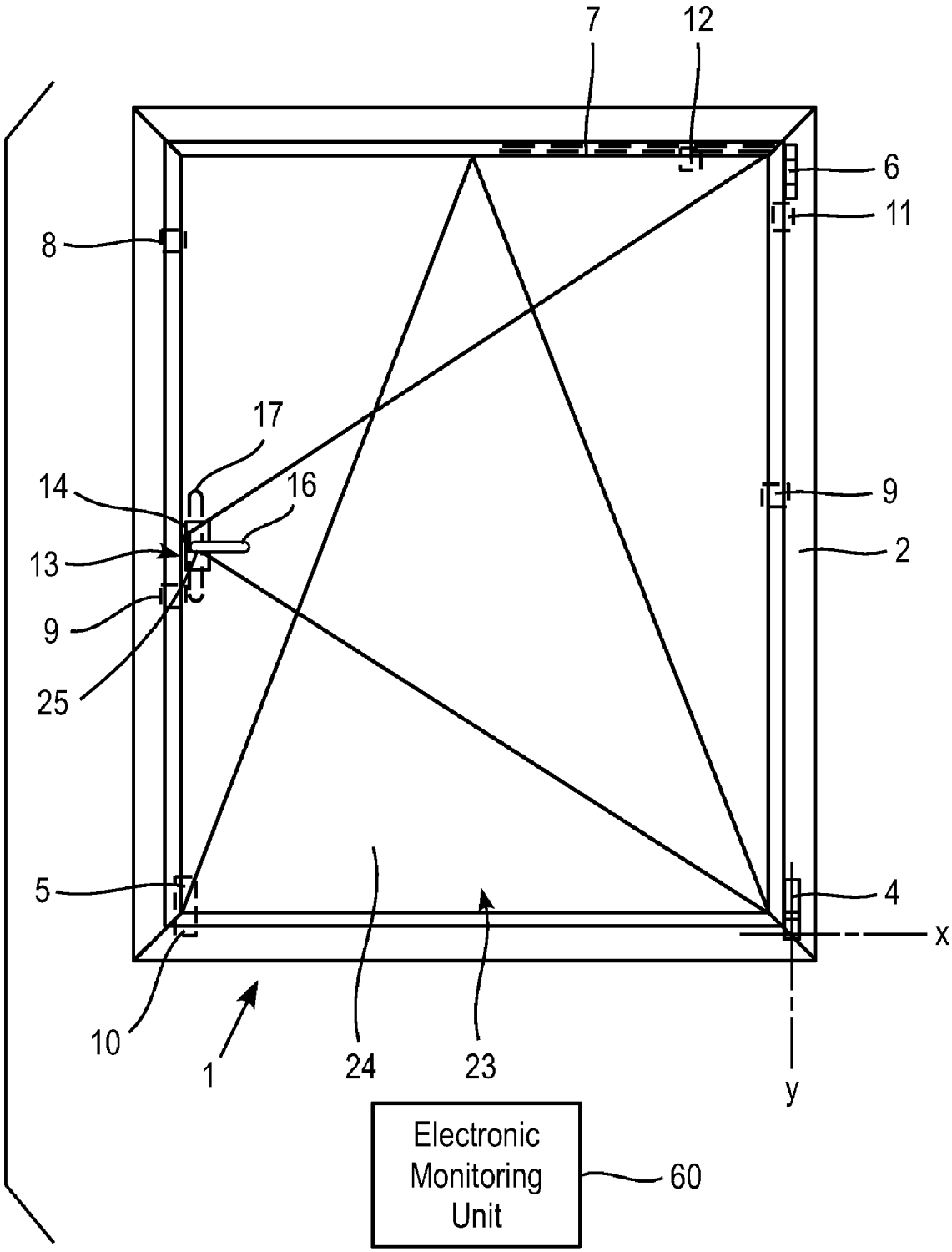
FIG. 6 is a schematic view of a frameless turn-tilt window with a first handle.

FIG. 6 is a schematic view of a frameless turn-tilt window with a first handle. FIG. 6 also illustrates an electronic monitoring unit 60 for registering a gripping position of the handle. Electronic monitoring unit 60 is allocated to the handle.

Similarly kinematic reversals, for example, with control curves at the locking abutments, may be realized. Similarly, the electromechanical drive may be put in the leaf; and the abutment, in the blind frame.

Table of Reference Numerals

| | |
|---|---|
| turn-tilt window | 1 |
| blind frame | 2 |
| casement frame | 3 |
| turn-tilt bearing | 4 |
| rocker bearing | 5 |
| turn hinge | 6 |
| deployment device | 7 |
| locking elements | 8, 9 |
| electromechanical element | 10, 11, 12 |
| handle | 13 |
| grip housing | 14 |
| lock position | 15 |
| turn position | 16 |
| tilt position | 17 |
| handle | 18 |
| loop-type grip | 19 |
| gripping position | 20, 21 |
| grip housing | 22 |
| leaf | 23 |
| pane | 24 |
| grip piece | 25 |
| rebated area | 26 |
| locking bolt | 27 |
| closing member | 28 |
| frame strut | 29, 30, 31, 32 |
| drive mechanism | 33 |
| tightening slope | 34 |
| projection | 35 |
| paths | a, b |
| unlocking spring | 36 |
| drive housing | 37 |
| stops | 38, 39 |
| housing wall | 40 |
| projection | 41 |
| head piece | 42 |
| eccentric pin | 43 |
| circular path | 44 |
| stop | 45 |
| axes | x, y |
| paths | a, b, c |

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A turn-tilt window, comprising:

a blind frame and a leaf, said leaf is tiltable in relation to the blind frame about a first axis and turnable in relation to the blind frame about a second axis;

fittings, located between the leaf and the blind frame, that control the turning or the tilting of the leaf in relation to the blind frame, the fittings including at least one turn-tilt bearing, a rocker bearing, and a turn hinge;

an electromechanical or electromagnetic functional element associated with at least one of the rocker bearing and the turn hinge in order to control the turning or the tilting of the leaf in relation to the blind frame, the functional element being controlled in a wireless or wired manner to move the at least one of the rocker bearing and the turn hinge into and out of a functional position of the at least one of the rocker bearing and the turn hinge, wherein the at least one of the rocker bearing and the turn hinge controls the turning or the tilting of the leaf relative to the blind frame when the at least one of the rocker bearing and the turn hinge is in the functional position of the at least one of the rocker bearing and the turn hinge;

a control unit operably configured to control the functional element to move the at least one of the rocker bearing and the turn hinge into and out of the functional position of the at least one of the rocker bearing and the turn hinge;

a rebated area disposed between the blind frame and the leaf when the leaf is in a closed position relative to the blind frame;

first and second electromechanical or electromagnetic locking elements disposed in the rebated area for locking the leaf in the blind frame when said leaf is in said closed position, wherein the first electromechanical or electromagnetic locking element includes a first electromechanical component that is displaceable into a first locking position and a first spring that urges the first electromechanical component into an open position, the second electromechanical or electromagnetic locking element includes a second electromechanical component that is displaceable into a second locking position by and a second spring that urges the second electromechanical component into an open position, the control unit is operatively configured for controlling the first and second locking elements;

an operating mechanism for controlling the functional element and the first and second locking elements;

the operating mechanism comprising an L-shaped handle mounted on the leaf, said handle comprising a first part having a longitudinal axis that is generally parallel to a pivot axis of the handle;

a grip piece having a longitudinal axis which is generally perpendicular to the pivot axis of the handle, the grip piece being movable into a number of different gripping positions corresponding to various operating conditions of the leaf; and at least one of switching elements and sensors, wherein the handle is coupled in the wireless or wired manner to the first and second locking elements, and is not operatively connected to the first and second locking elements by way of any mechanical linkages for opening and closing of the leaf, wherein the handle is coupled in the wireless or wired manner to the functional element associated with the at least one of the rocker bearing and the turn hinge and is not operatively connected to the functional element or the at least one of the rocker bearing and the turn hinge by way of any mechanical linkages for opening and closing of the leaf, and wherein the handle is coupled in the wireless or wired manner to an electromechanical drive mechanism which is adapted to open and close the leaf, wherein the blind frame and the leaf do not have any connecting rods; and wherein the handle is configured for manual opening and closing of the leaf.

2. The turn-tilt window, as claimed in claim 1, wherein the at least one of the rocker bearing and the turn hinge comprises the rocker bearing, and an additional electromechanical or electromagnetic functional element is associated with the turn hinge in order to control the turning or the tilting of the leaf relative to the blind frame.

3. The turn-tilt window, as claimed in claim 2, wherein the functional element associated with the rocker bearing controls movement of the rocker bearing into and out of the functional position of the rocker bearing in such a manner that the rocker bearing acts as a rotary joint when the rocker bearing is in the functional position of the rocker bearing, and the additional functional element controls movement of the turn hinge into and out of a functional position of the turn hinge in such a manner that the turn hinge acts as a rotary joint when the turn hinge is in the functional position of the turn hinge.

4. The turn-tilt window, as claimed in claim 1, further comprising an electric monitoring unit associated with the handle and monitoring the at least one of switching elements and sensors, for registering the gripping positions of the grip piece.

5. The turn-tilt window, as claimed in claim 4, wherein the handle is coupled to at least one of the monitoring unit and the control unit in the wireless manner.

6. The turn-tilt window, as claimed in claim 4, wherein the handle is coupled to at least one of the control unit and the monitoring unit by an electric line or by at least one data line.

7. The turn-tilt window, as claimed in claim 1, further comprising a deployment device for defining a tilt and a turn moveability of the leaf.

8. The turn-tilt window, as claimed in claim 7, wherein the electromechanical drive mechanism is associated with the deployment device.

9. The turn-tilt window, as claimed in claim 7, wherein the electromechanical drive mechanism comprises an additional functional element and the deployment device.

10. The turn-tilt window, as claimed in claim 1, wherein an electronic circuit is allocated to the handle and is mounted directly on the leaf.

11. The turn-tilt window, as claimed in claim 10, wherein the electronic circuit of the handle is disposed in a grip housing.

12. The turn-tilt window, as claimed in claim 1, wherein the leaf is a frameless leaf.

13. The turn-tilt window, as claimed in claim 1, wherein the leaf has a casement frame.

14. A turn-tilt window, comprising:

a blind frame;

a leaf that is tiltable in relation to the blind frame about a first axis and is turnable in relation to the blind frame about a second axis;

a turn hinge located between the leaf and the blind frame that controls the turning movement of the leaf in relation to the blind frame, wherein a first electromechanical or electromagnetic functional element is associated with the turn hinge in order to control the turning movement of the leaf in relation to the blind frame, wherein the first functional element is drivable in a wireless or wired manner to move the turn hinge into and out of a functional position, wherein the turn hinge controls the turning movement of the leaf relative to the blind frame when said turn hinge is in said functional position;

a rocker bearing located between the leaf and the blind frame that controls the tilting movement of the leaf in relation to the blind frame, wherein a second electromechanical or electromagnetic functional element is associated with the rocker bearing in order to control the tilting movement of the leaf in relation to the blind frame, wherein the second functional element is drivable in the wireless or wired manner to move the rocker bearing into and out of a functional position, wherein the rocker bearing controls the tilting movement of the leaf relative to the blind frame when said rocker bearing is in said functional position of said rocker bearing;

a turn-tilt bearing located between the leaf and the blind frame arranged to support the leaf in relation to the blind frame as the leaf tilts about the first axis and turns about the second axis;

a control unit operably configured to control driving of the first functional element to move the turn hinge into and out of the functional position of the turn hinge and to control driving of the second functional element to move the rocker bearing into and out of the functional position of the rocker bearing;

first and second electromechanical or electromagnetic locking elements serving to lock the leaf in the blind frame when the leaf is in a closed position relative to the blind frame, wherein the first electromechanical or electromagnetic locking element includes a first electromechanical component that is displaceable into a first locking position and a first spring that urges the first electromechanical component into an open position, the second electromechanical or electromagnetic locking element includes a second electromechanical component that is displaceable into a second locking position and a second spring that urges the second electromechanical component into an open position, the control unit is operatively configured for controlling driving of the first and second locking elements;

an operating mechanism comprising an L-shaped handle mounted on the leaf, said handle comprising a first part having a longitudinal axis that is generally parallel to a pivot axis of the handle;

a grip piece having a longitudinal axis which extends generally perpendicular to the pivot axis of the handle, said grip piece being movable into a number of different gripping positions corresponding to various operating conditions of the leaf, wherein the handle is wired or wirelessly connected, but not operatively connected by any mechanical linkages, to the first and second locking elements, the turn hinge and the rocker bearing;

wherein the blind frame and the leaf do not have any connecting rods; and wherein the handle is configured for manual opening and closing of the leaf.

* * * * *